US007032495B2

(12) United States Patent
Moser et al.

(10) Patent No.: US 7,032,495 B2
(45) Date of Patent: Apr. 25, 2006

(54) COMBAT VEHICLE HAVING AN OBSERVATION SYSTEM

(75) Inventors: Hans Moser, Bergen (DE); Hermann Grosch, Nienhagen (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 133 days.

(21) Appl. No.: 10/349,936

(22) Filed: Jan. 24, 2003

(65) Prior Publication Data

US 2003/0136253 A1 Jul. 24, 2003

(30) Foreign Application Priority Data

Jan. 24, 2002 (DE) ..... 102 02 548

(51) Int. Cl.
*F41G 5/24* (2006.01)

(52) U.S. Cl. ..... 89/203; 89/41.19

(58) Field of Classification Search ..... 89/41.17, 89/41.09, 41.19, 200–206
See application file for complete search history.

(56) References Cited

U.S. PATENT DOCUMENTS

| | | | | | |
|---|---|---|---|---|---|
| 4,346,520 | A | * | 8/1982 | Moore | 33/645 |
| 4,384,293 | A | * | 5/1983 | Deem et al. | 342/352 |
| 4,949,089 | A | | 8/1990 | Ruszkowski, Jr. | |
| 5,280,744 | A | * | 1/1994 | DeCarlo et al. | 89/41.19 |
| 5,781,437 | A | * | 7/1998 | Wiemer et al. | 701/2 |
| 5,822,713 | A | * | 10/1998 | Profeta | 701/302 |
| 6,012,376 | A | * | 1/2000 | Hanke et al. | 89/41.19 |
| 6,260,466 | B1 | * | 7/2001 | Humphreys | 89/41.06 |
| 6,466,871 | B1 | * | 10/2002 | Reisman et al. | 701/224 |
| 2003/0140775 | A1 | * | 7/2003 | Stewart | 89/41.05 |

FOREIGN PATENT DOCUMENTS

| | | | |
|---|---|---|---|
| DE | 3342338 | A1 * | 9/1985 |
| DE | 4207251 | A1 * | 9/1993 |
| EP | 402174 | A1 * | 12/1990 |
| FR | 2564580 | A * | 11/1985 |
| GB | 2363001 | A * | 12/2001 |

OTHER PUBLICATIONS

"Abrams M1A1/2—Main Battle Tank", www.army–technology.com, (Jan. 8, 2001).*
"M1 Abrams Main Battle Tank", FAS Military Analysis Network, (Apr. 14, 2000).*
"Who Goes There? How the U.S. Army's new satellite tracking system helped avert friendly fire and lift the fog of war in Iraq", Bruce T. Robinson, (Oct. 2003).*
"GPS and Army Digitization Move Forward at Fort Irwin", Pathfinder, vol. 8, issue 3, Jul. 2001.*
"Army Transformation Changes Force Targets for Digitization", Robert Ackerman, Signal Magazine, Jul. 2000.*
"Army Develops Improved Global Positioning System", Stephen Larsen, http://www.fas.org/spp/military/program/nav/a19980915newgps.html.*

* cited by examiner

*Primary Examiner*—Michael J. Carone
*Assistant Examiner*—Troy Chambers
(74) *Attorney, Agent, or Firm*—Venable LLP; Stuart I. Smith

(57) ABSTRACT

A combat tank is converted into an artillery observation tank without requiring removal of the main gun. The combat tank is converted by integrating retrofitted equipment necessary for the artillery observation, especially the navigation system (12), into the vehicle turret (4) such that it does not collide with the main gun. The navigation system (12) is installed with an arbitrary orientation at an arbitrary location in the vehicle turret (4), and adjusted at this location, without requiring a complicated adjustment mechanism for the observation system, or attachment to the elevating mass. The necessary elevation values for the line of sight (21) are obtained through the evaluation of the angular values of a mirror in the mirror head, such as of a primary-target telescope (20), or through evaluation of gun-position angles.

14 Claims, 3 Drawing Sheets

COMBAT VEHICLE HAVING AN OBSERVATION SYSTEM

CROSS-REFERENCE TO RELATED APPLICATION

This application claims the priority of German Patent Application No. 102 02 548.7 filed Jan. 24, 2002, which is incorporated herein by reference.

BACKGROUND OF THE INVENTION

For artillery weapons systems to be utilized effectively, it is critical to range targets precisely. Numerous technical land- and air-supported means are available for this purpose.

One of the best-known artillery reconnaissance devices is an advanced observer that identifies and ranges targets.

Onboard observation systems that serve this purpose are also known.

DE 42 07 251 C2 describes a system in which a tank for combating ground targets is equipped with an image-controlled weapons system. The combat vehicle is provided with a fire-control system and imaging sensors. Signal lines connect the fire-control system to a weapon-guidance system. The two imaging sensors are located externally, on the vehicle turret, with the first sensor serving to track targets and the second serving to reconnoiter and acquire targets. The observation system, however, only supplies its own fire-control system with corresponding information. External weapons, etc., cannot receive this information.

DE 33 42 338 A1 discloses a tank that functions both as a central observer (guide vehicle) and a combination observation and combat vehicle. The tank provides other tanks that are located throughout the area and are part of the same unit with fast, relatively precise target assignments. A stationary sensor or a sensor whose position has been stabilized to form a fixed reference system performs the target observation. The necessary target coordinates are obtained as stationary coordinates on a reference screen of this stationary sensor, with the help of a monitor stylus. They are then converted in an electronic device into the respective target coordinates of the individual observation or weapons system, and transmitted to the systems in a data transmission.

A simple solution of this nature does not suffice to meet the requirements placed on current observers with respect to fire control for an artillery unit and the associated, necessary components for the observation system. In order to range targets precisely, contemporary observers, which typically comprise a laser range-measuring device, a bearing device, e.g. a north-seeking gyro-compass, a navigation device and an IR device for day/night vision, must possess a corresponding self-movement capability, protection against enemy weaponry and the ability to allow the artillery unit to re-engage in combat after a quick position change.

Because known artillery observation tanks have the disadvantages that they are only lightly armored, insufficiently mobile and incapable of night vision, the emerging trend is toward equipping combat tanks to be observation tanks.

In doing so, it is possible either to place a portable system in the combat tank or integrate the system into the combat tank.

The article "Der Beobachtungspanzer Artillerie Leopard 1A5 [The Artillery Observation Tank Leopard 1A5]" in "wt" III/98, pp. 108–109 describes combat tanks that have been converted into observation tanks. The article details the numerous advantages of converting a combat tank into an observation tank. For example, a thermal-imaging device present in the combat tank and the fire-control system can be utilized. A navigation system and a data input/output device are then retrofitted. All of the components are housed in the tank turret, so the main gun has to be removed. The navigation system is secured to a cradle roller that can be moved through the entire elevation region, actuated by a vertical elevation cylinder. The bearing process orients the navigation system in the direction of the line of sight. It is unadvisable to mount the navigation system in the turret or on the chassis.

An article in "Soldat und Technik [Soldier and Technology]" 5/1998, pp. 337–340 also speaks in favor of converting a combat tank into an observation tank. This makes viewing means, such as a primary-target telescope and, under poor visibility conditions or in darkness, thermal imaging, that are already provided on the combat tank available for an observation officer to use in target recognition and location. A retrofitted navigation system with GPS support is utilized in determining position and bearing. In order to combat the target, target data that have been converted into a target report in a retrofitted computer are transmitted to a specified group of addressees via radio devices, which may be increased in number as needed. Also in this case, the conversion requires that a sizeable portion of the main weapons system be removed to make the necessary room for integrating the artillery elements (assemblies). A portable target-locating device is also transported externally, on the turret.

The vehicles converted in this manner are no longer usable for combat assignments, because they lack their main gun.

SUMMARY OF THE INVENTION

It is therefore the object of the invention to provide a combat vehicle that permits an artillery observation and ranging of targets, without having a limited combat function.

In a modification of the invention, the additional equipment is in the form of retrofitted devices that can be incorporated without any modification to the combat vehicle, and can be removed again at any time.

This above object generally is achieved according to the invention by a combat vehicle having a primary weapons system and an artillery observation system, and including: a vehicle turret, in which a fire-control computer is housed, and having a primary weapon system, a range-measuring device, a thermal-imaging device and at least one primary-target telescope mounted on the turret; and wherein the fire-control computer is connected via a signal adapter to a control device that connects the fire control computer to a navigation system that is installed in the vehicle turret and that is adjusted such that a fixed reference between a line of sight of the primary-target telescope and the coordinate system of the navigation system and measured elevation values is created.

The concept of the invention is not to convert, but to additionally rig, a combat vehicle, thereby integrating the retrofitted equipment that is necessary for the artillery observation, especially the navigation system, into the vehicle turret such that it does not collide with the main gun. The navigation system can be installed with an arbitrary orientation at an arbitrary location in the vehicle turret, and adjusted at this location. It is not necessary to provide a complicated adjustment mechanism for the observation system, or to secure it to the elevating mass. The necessary elevation values for the line of sight are obtained through the evaluation of the angular values of the mirror in the mirror head, such as of a primary-target telescope, or through the evaluation of the gun-position angle.

In a modification of the invention, sensors (assemblies) of modern fire-control systems that are present in the vehicle perform a dual function. That is, the source or assembly are also used for the artillery observations and ranging, in which case the present signals are prepared for the artillery observer. The provided sensors include, among others, a (panoramic) periscope, a primary-target telescope, a laser range-measuring device and a thermal-imaging device. The only components remaining to be installed are a control computer and a navigation system. The latter can be permanently installed in the turret. If need be, a further radio device can be incorporated.

This solution is economical. In addition, the procedure can be performed in the field.

The integration of the assemblies requires no modifications of the vehicle. In other words, after disassembly, the vehicle is returned to its original state.

An equally important advantage, however, is that the retrofitted artillery observer cannot be recognized from the outside, because there are no additional assemblies that are externally visible.

The integration of the retrofitted assemblies into the vehicle turret thus permits unlimited functioning of a combat tank, the use of provided fastening flanges, bores or alcoves, and a low-vibrating mounting.

The invention is described in detail below by way of an exemplary embodiment shown in the drawing.

BRIEF DESCRIPTION OF THE PREFERRED EMBODIMENTS

Figure 1:
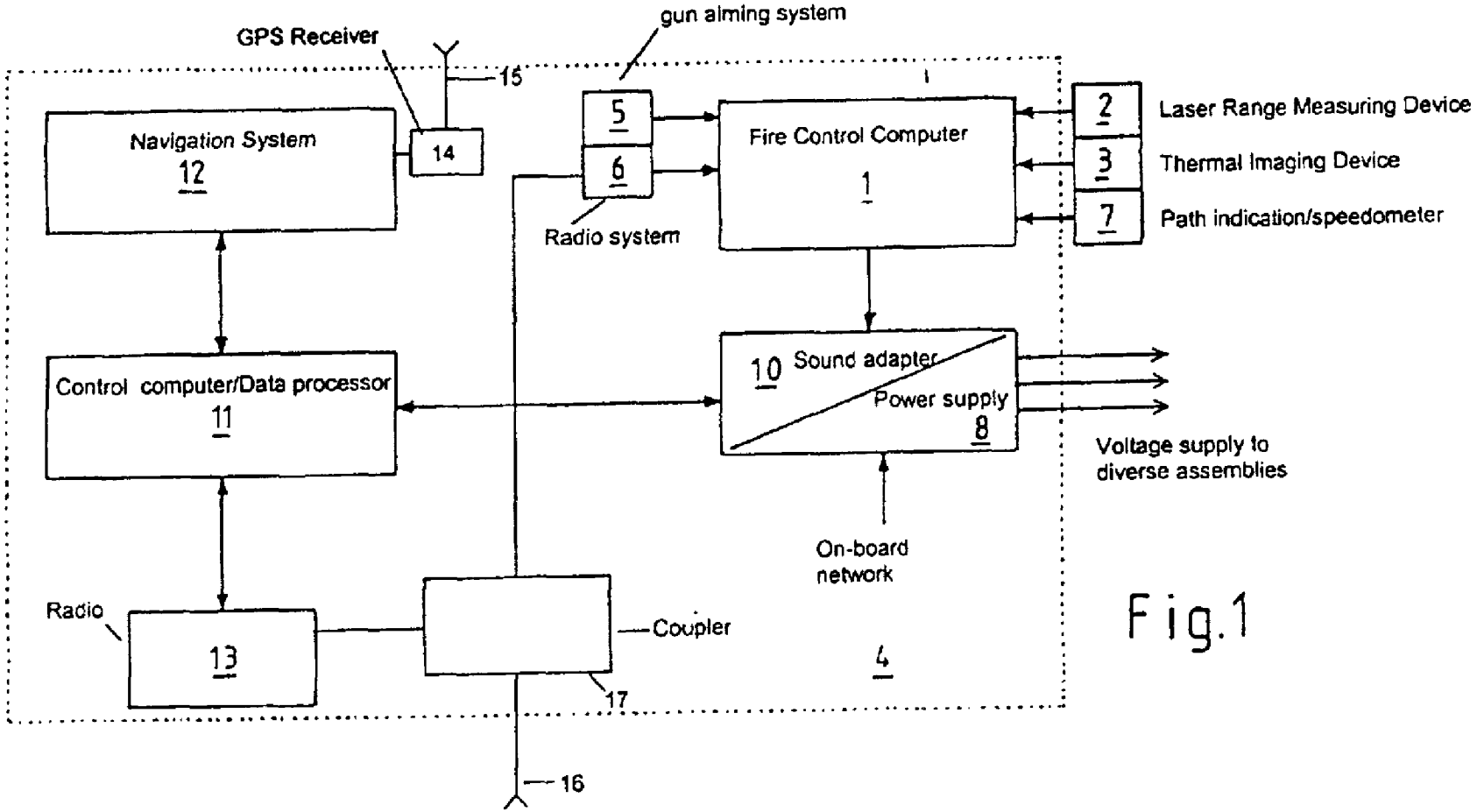
FIG. 1 shows the assemblies in required in that for the dual function, in simplified form in a block-like illustration.

FIG. 1 shows the assemblies required for the dual function of a combat vehicle and an artillery observer, in a simplified block diagram.

Assemblies present in the combat vehicle include a fire-control computer 1, a viewing system (e.g., a primary-target telescope 20 as indicated in FIG. 2) having a laser range-measuring device 2 and a thermal-imaging device 3, as well as a panoramic telescope (periscope—not shown in detail), which operates independently of the turret position. The fire-control computer 1 is generally located in the electronics compartment of a vehicle turret 4. Further useful assemblies are a gun-aiming system 5, a radio system 6 and a path indicator/speedometer 7.

A signal adapter 10 connects the fire-control computer 1 to a control device/data-processing device 11, which connects the computer to a navigation system 12. An additional radio device 13 can be connected to the control device 11, which is a control computer having a monitor, preferably a laptop. The radio device 13 serves in data communication with a master fire-control site or other combat tanks that may or may not have an observation system. One of the provided aerials, for example the aerial 16 for the radio system 6 is preferably used in data communication, so the radio device 13 is connected to the aerial 15 via an aerial coupler 17.

To determine position, the navigation system 12 preferably uses at least one annular laser gyroscope and one acceleration detector (not shown in detail). This assures high navigating precision.

The precision can be enhanced by a GPS signal of a GPS receiver 14 having an aerial 15, and/or a path-indicator signal obtained from the speedometer signal.

The signal adapter 10 represents the central interface between the assemblies provided in the combat vehicle and the assemblies to be retrofitted for the artillery observer, and serves not only in signal preparation, but also in supplying current to the retrofitted assemblies, for which purpose a power supply 8 in the vehicle turret 4 can be tapped.

The signal adapter 10 converts the information and signals of the present assemblies into usable signals required by the artillery observer. For example, a speedometer signal generated in gear electronics (not shown in detail) as speed information pertaining to the vehicle can also be used for the observer. This speedometer signal is then supplied to the fire-control system 1 via a slip ring, for example, then tapped from there. The signal adapter 10 converts this speedometer signal into a path-indicator signal that can be used for the navigation system 12. A turret-position signal available in the vehicle turret 4 can also be tapped by the fire-control computer 1 and converted by the signal adapter 10.

For the functioning of the observer, it is necessary to match the navigation system 12, in particular, to the opto-electronic (coordinate) system of the gun. That is, it is necessary to adapt a coordinate system in the navigation system 12 that is equivalent or corresponds to the coordinate system of he gun. The navigation system must be adjusted for this purpose. In other words, the purpose of the adjustment is to create a fixed reference between a line of sight 21 of a primary-target telescope 20 of the tank and the coordinate system of the navigation system 12, and the measured elevation values. The adjustment is effected with software support.

Figure 2A:
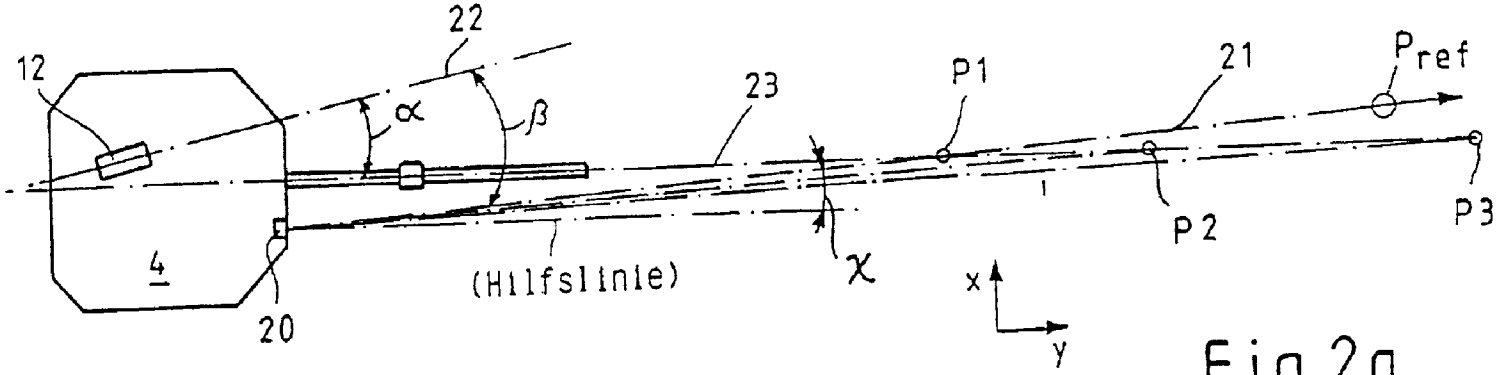
FIGS. 2*a* and 2*b* illustrate the adjustment for an azimuth and a tilt orientation respectively of a navigation system.

The installation of the navigation system 12 without a mechanical adjustment results in a deviation of the position of the optical line of sight 21 (optical axis of the primary-target telescope 20 of the tank) relative to the reference axis 22 of the navigation system 12, which produces not only a mechanical offset value $\alpha$ (reference axis 22 of the navigation system 12 relative to a bore axis 23), but also a further offset value $\chi$ due to the parallax correction of the primary-target telescope 20 relative to the bore axis 23 (artificial line) (See FIG. 2*a*).

Figure 2B:
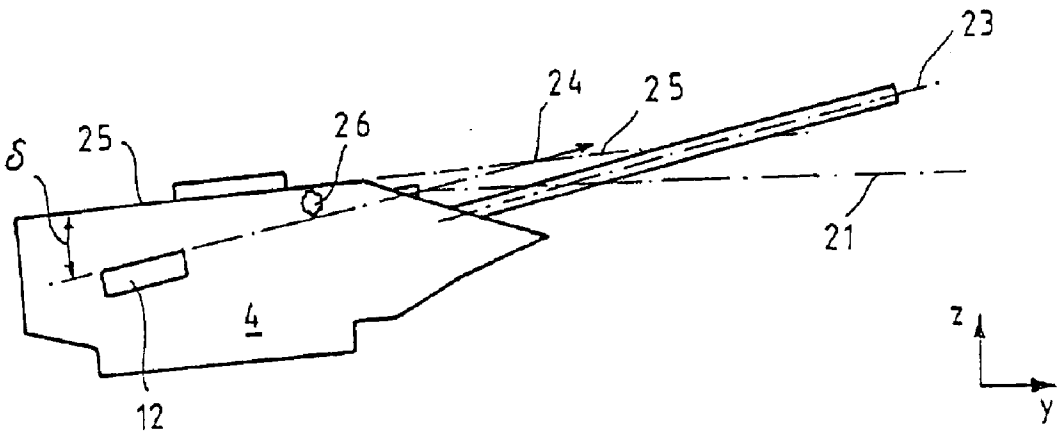

With respect to the position in the turret 4, the navigation system 12 has a further offset variable $\delta$ between the reference plane 24 and the adjustment reference plane 25 (turret reference plane) (FIG. 2*b*).

The total offset $\beta$ of the navigation system 12 with respect to the optical line of sight 21 and the height offset $\delta$ must therefore be corrected or adjusted.

For the adjustment, the bearing value of north and the associated orientations of the optical line of sight 21 and the bearing indicator of the navigation system 12 must be determined. The reference system is the earth's coordinate system X-Y-Z, in which the navigation system 12 performs measurements.

First, the navigation system 12 is adjusted with respect to its canting and tilting in the vehicle turret 4 to ascertain the reference plane 22. After the switch-on, this automatically determines the canting and tilting angle in the compartment, i.e., the vehicle turret 4.

The bearing value of the line of sight 21 with respect to north can be determined by sighting a reference point $P_{ref}$ measured within the area or, as an alternative, by sighting a measured theodolite, in which case the eigenposition is determined, as is the position of the distant reference point $P_{ref}$, which must be visible from the vehicle. Typical distances are about 1000–3000 m. The line of sight 21 is guided exactly to this point $P_{ref}$. After the two points and the range have been (automatically) entered into the control computer 11, the position of the line of sight 21 in the earth's coordinate system can be calculated in a known manner, and is then known.

The value of the parallax correction is a function of the range (P1, P2, P3), and can be determined from the target range.

Hence, the mechanical offset β of the navigation system in the azimuth direction is known. The ascertained offset values are automatically transmitted to the control computer 11.

The navigation system 12 must additionally be adjusted in terms of its canting and tilting relative to the vehicle turret 4 since it is not in the turret. This is effected through the measurement of the turret reference plane 25 relative to the earth's coordinate system, with the aid of a quadrant bubble-level 26 on the vehicle turret 4 and through a comparison to the canting and tilting angles measured by the navigation system 12. These two values, as well as the coordinates of the vehicle position, are transmitted from the navigation system 12 into the control computer 11 and stored. The fire-control computer 1 can directly detect and store the elevation angle of the mirror of the primary-target telescope 20.

The determined offset and calibration values are taken into account in the target ranging.

After a gunner has sighted a foreign target, the laser range-measuring device 2 measures the range to the target and the elevation angle of the mirror of the primary-target telescope 20, and thus the elevation angle between the target and the vehicle. Alternatively, the tank periscope, which cooperates functionally with the primary-target telescope 20, can be employed in assigning a target.

If angles of the mirror and/or the gun can only be measured in relative terms, it is possible to determine and store a reference value in the self-adjustment. These values are present in signal form at the signal adapter 10, and are read into the control device 11.

In addition, the bearing angle with respect to north, the canting and tilting angles of the vehicle and the vehicle location are simultaneously read out of the navigation system 12.

The control device 11 calculates the target position from these values.

If the inherent speed of the vehicle is also required, this information can be obtained from the speedometer signal.

These target coordinates can now be transmitted by radio, directly or after verification by the commander using map material, to a master fire-control site.

Figure 3:
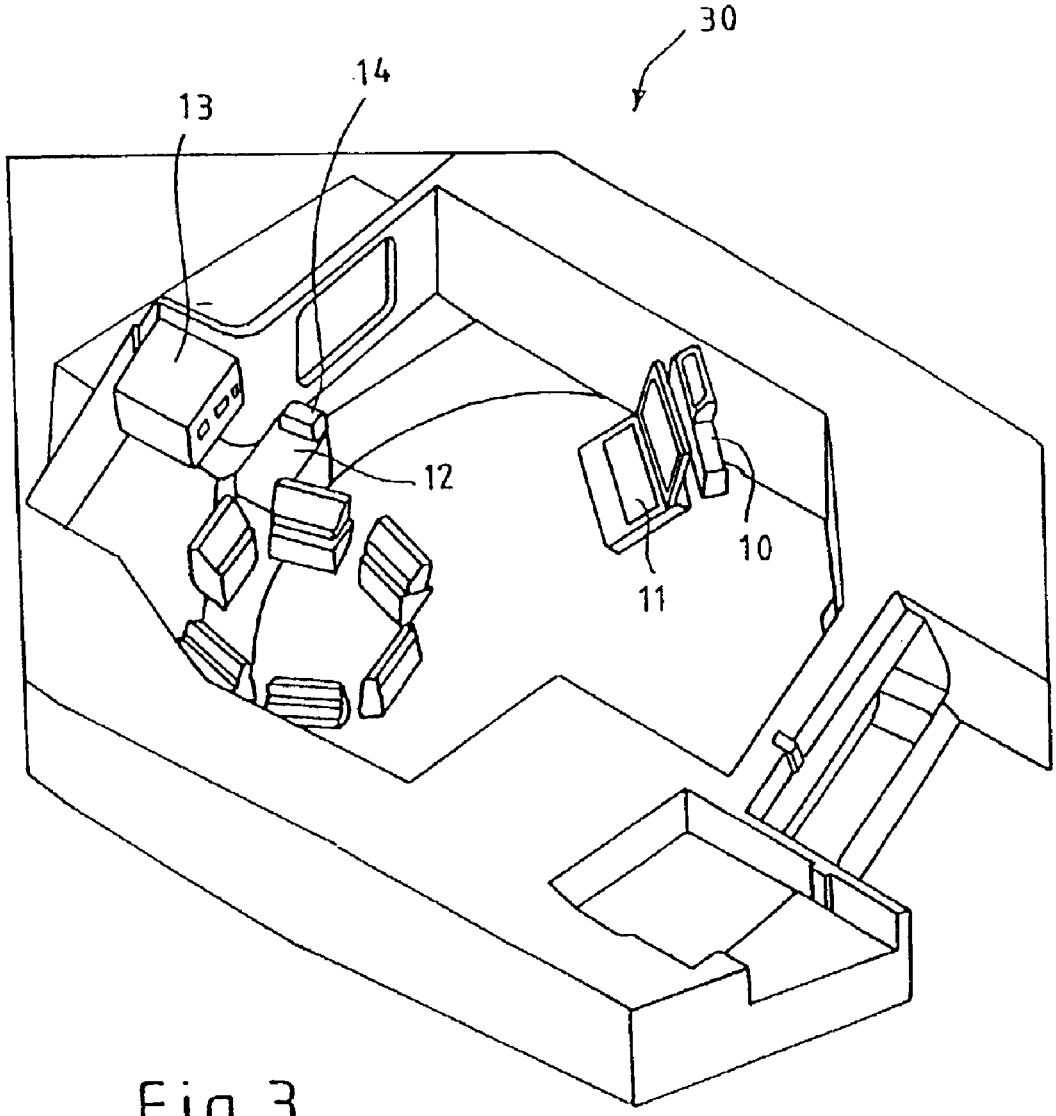
FIG. 3 illustrates a vehicle turret containing the necessary assemblies without its cover, in a plan view.

FIG. 3 illustrates the integration of the assemblies to be retrofitted.

Because of the limited available space at the gunner and commander stations, the assemblies to be integrated are preferably disposed in the region of a gun-loading area 30 of the turret 4. The navigation system 12 and the GPS 15 are mounted together, for example, as are the control computer 11 and the signal adapter 10. The radio device 13 can likewise be secured in existing bores in the turret 4.

The invention now being fully described, it will be apparent to one of ordinary skill in the art that many changes and modifications can be made thereto without departing from the spirit or scope of the invention as set forth herein.

What is claimed is:

1. A combat vehicle having a primary weapons system and an artillery observation system, with said vehicle including a vehicle turret, in which a fire control system including a fire-control computer is housed, as well as the primary weapon system, a range-measuring device, a thermal-imaging device and at least one primary-target telescope mounted on the turret; and wherein the fire-control computer is connected via a signal adapter to a control device that connects the fire control computer to a navigation system that is installed in the vehicle turret and that creates a fixed reference between a line of sight of the primary-target telescope and a coordinate system of the navigation system and measured elevation values.

2. The combat vehicle according to claim 1, wherein the coordinate system of the navigation system is the earth's coordinate system.

3. The combat vehicle according to claim 1, wherein at least one determining device determines a bearing value of north, an associated position of the optical line of sight and the position of the navigation system in the vehicle turret for the adjustment of the navigation system.

4. The combat vehicle according to claim 3, wherein the navigation system includes means for automatically determining the navigation system's canting and tilting angles in the vehicle turret relative to the navigation system's position in the vehicle turret, and means for determining a plane of reference.

5. The combat vehicle according to claim 3, wherein at least one of the determining devices determines the bearing value of the line of sight relative to north through sighting of a measured reference point ($P_{ref}$) in the area, or the sighting of a measured theodolite, in which case at least one of the determining devices determines the eigenposition and the position of the remote reference point ($P_{ref}$).

6. The combat vehicle according to claim 5, wherein a guidance device exactly guides the line of sight to the reference point ($P_{ref}$), and after the two points and the range have been entered into the control computer; and wherein the control computer calculates the position of the line of sight in the earth's coordinate system.

7. The combat vehicle according to claim 1, further comprising a quadrant bubble level mounted on the turret for additional determining the canting and tilting angles of the vehicle turret with respect to the earth's coordinate system.

8. The combat vehicle according to claim 1, wherein the adjustment of the navigation system is supported by software.

9. The combat vehicle according to claim 1, wherein the fire control system includes a radio device with an aerial; and, further comprising at least one further radio device for data communication with other combat vehicles by the control device.

10. The combat vehicle according to claim 9, wherein the at least one further radio device is coupled to the aerial for the radio device of the fire control system via an aerial coupler, thereby obviating the use of an additional aerial.

11. The combat vehicle according to claim 1, further comprising a Global Positioning System (GPS) having a receiver and an aerial integrated into the vehicle turret and connected to the navigation system for enhancing navigating precision.

12. The combat vehicle according to claim 1, wherein: the fire control system includes a radio device with an aerial; at least one further radio device for data communication with combat vehicles by the control device is provided; the additional radio device is coupled to the aerial for the radio device of the fire control system via an aerial coupler, thereby obviating the use of an additional aerial; and, the additional radio device and the aerial coupler likewise are retrofitted in the region of the gun-loading area of the turret.

13. The combat vehicle according to claim 1, wherein the control device is a control computer having a monitor.

14. The combat vehicle according to claim 13, wherein the control device is a laptop computer.

* * * * *